US005276485A

United States Patent [19]

Osbourne et al.

[11] Patent Number: 5,276,485

[45] Date of Patent: Jan. 4, 1994

[54] PHOTOCONDUCTIVE BELT SUPPORT

[75] Inventors: William G. Osbourne, Webster; Douglas J. Baxendell, Rochester; David E. Rollins, Lyons, all of N.Y.

[73] Assignee: Xerox Corporation, Stamford, Conn.

[21] Appl. No.: 762,197

[22] Filed: Sep. 19, 1991

[51] Int. Cl.[5] ..... G03G 5/00; G03G 15/00; G03G 21/00

[52] U.S. Cl. ..... 355/212; 355/72

[58] Field of Search ..... 355/211, 212, 72, 73

[56] References Cited

U.S. PATENT DOCUMENTS

| | | | |
|---|---|---|---|
| 3,867,027 | 2/1975 | Weigl | 355/212 X |
| 3,880,517 | 4/1975 | Dennie | 355/212 X |
| 3,880,518 | 4/1975 | Chatfield | 355/212 |
| 4,096,826 | 6/1978 | Stange | 118/656 |
| 4,178,094 | 12/1979 | Silverberg | 355/212 |
| 4,204,731 | 5/1980 | Kohler et al. | 355/212 X |
| 4,230,406 | 10/1980 | Klett | 355/305 |
| 4,279,496 | 6/1981 | Silverberg | 355/212 |
| 4,396,274 | 8/1983 | Kollar et al. | 355/212 |
| 4,425,034 | 1/1984 | Roodbergen | 355/212 |
| 4,483,607 | 11/1984 | Nagayama | 355/212 |
| 4,766,403 | 8/1988 | Sasaki et al. | 355/212 |

*Primary Examiner*—Fred L. Braun

*Attorney, Agent, or Firm*—H. Fleischer; J. E. Beck; R. Zibelli

[57] ABSTRACT

An electrophotographic printing machine in which a moving photoconductive belt is supported in the region of the processing stations thereof. The photoconductive belt is guided in an endless path of movement. The region of the photoconductive belt opposed from at least one of the processing stations is maintained substantially planar with photoconductive belt flutter being substantially dampened.

9 Claims, 2 Drawing Sheets

PHOTOCONDUCTIVE BELT SUPPORT

Figure 1:
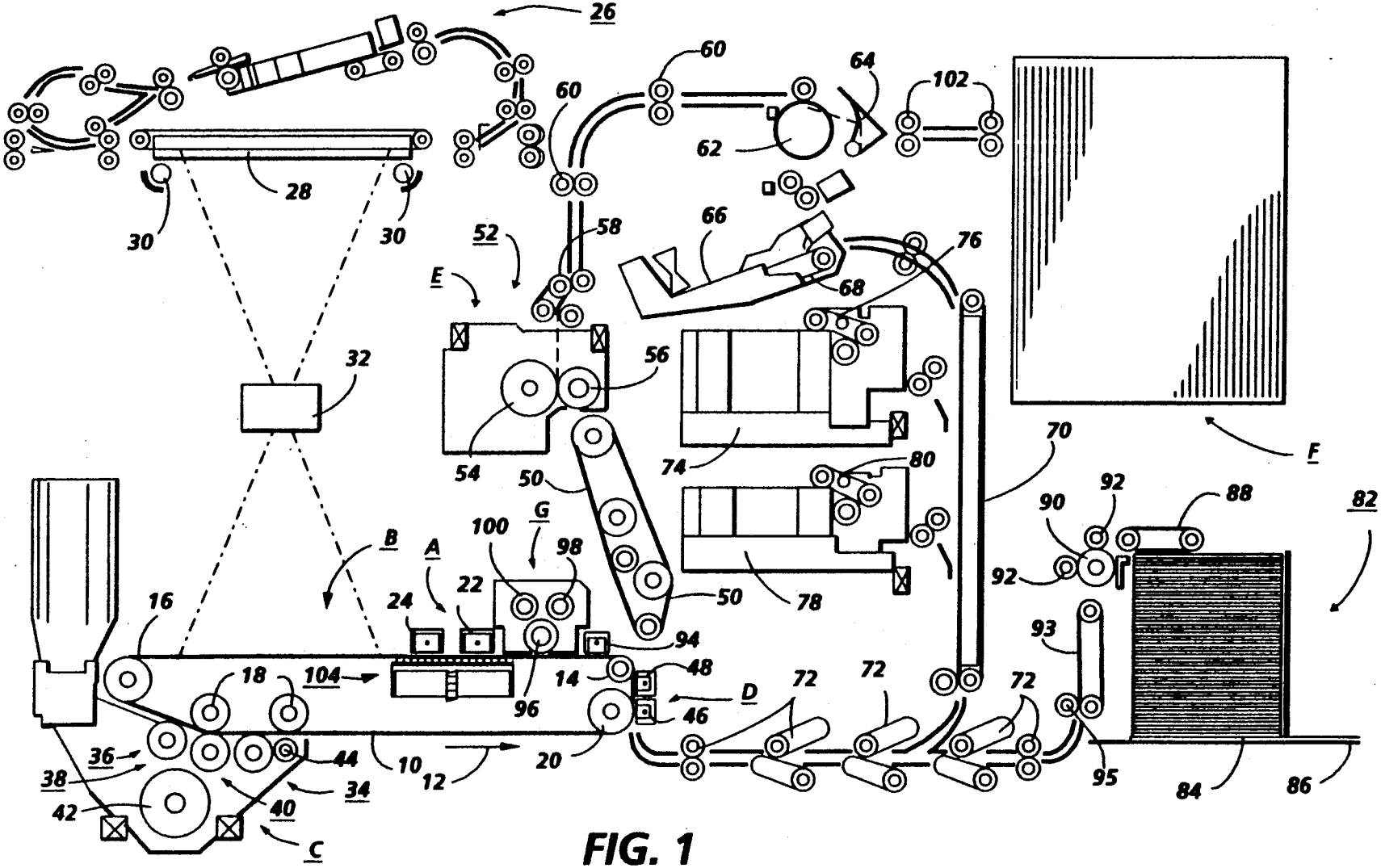

This invention relates generally to an electrophotographic printing machine, and more particularly concerns a support for maintaining a region of a photoconductive belt substantially planar.

In a typical electrophotographic machine, a photoconductive member is charged to a substantially uniform potential to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developed material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In a high speed commercial printing machine of the foregoing type, the photoconductive member is frequently a photoconductive belt. When a photoconductive belt is employed, it is necessary to maintain at least the portion of the photoconductive belt opposed from the various processing stations in the printing machine substantially flat or planar. One way of obtaining the desired flattened portion in the belt is with a vacuum platen to draw the surface of the belt opposite therefrom into contact therewith. In that way, the belt has a substantially flattened portion. This ensures that there is correct spacing between the various processing units and the surface of the belt. However, if for any reason, the photoconductive belt flutters or is displaced in a direction substantially normal to the direction of movement thereof, the critical spacing between the processing unit and the belt is effected. This may very well result in improper and undesirable images being recorded on the photoconductive belt or improper development thereof. Thus, it is necessary to precisely control photoconductive belt flutter, i.e. belt movement in a direction normal to the path of movement thereof. It has been found that in high speed printing machines, without the control of photoconductive belt flutter, various processing stations are not capable of operating to achieve the desired image quality. For example, without photoconductive belt flutter control, the charging unit is not able to provide a sufficiently uniform charging of the photoconductive belt. Similarly, focusing an image of a line screen on a charged portion on the photoconductive belt is degraded. Furthermore, cleaning of the photoconductive belt may also be degraded. Thus, it has been found that it is necessary to control photoconductive belt flutter in order to ensure that the desired copy quality is achievable in a high speed printing machine. Heretofore, various approaches have been devised for maintaining regions on the photoconductive belt substantially flat. However, these techniques do not appear to consider the problem of controlling photoconductive belt flutter. The approaches previously used are illustrated by the following disclosures, which may be relevant to certain aspects of the present invention:

- U.S. Pat. No. 3,880,518; Patentee: Chatfield; Issued: Apr. 29, 1975.
- U.S. Pat. No. 3,880,517; Patentee: Denni; Issued: Apr. 29, 1975.
- U.S. Pat. No. 4,096,826; Patentee: Stange; Issued: Jun. 27, 1978.
- U.S. Pat. No. 4,279,496; Patentee: Silverberg; Issued: Jul. 21, 1981.
- U.S. Pat. No. 4,230,406; Patentee: Sklett; Issued: Oct. 28, 1980.

Relevant portions of the foregoing patents may be briefly summarized as follows:

U.S. Pat. No. 3,880,517 and U.S. Pat. No. 3,880,518 disclose a floating platen supporting a photoconductive belt opposed from a development station. The platen is mounted for movement to and from the surface of the photoconductive belt opposed therefrom on the frame of the printing machine.

U.S. Pat. No. 4,096,826 discloses a deflection member having a generally planar surface with a plurality of apertures therein. Pressurized air passes through the apertures in the planar surface to form an air cushion against the photoconductive belt. The air cushion deflects the photoconductive belt into an operative position adjacent a magnetic brush developer roller.

U.S. Pat. No. 4,279,496 describes a support for a photoconductive belt. The support has a generally planar exterior surface opposed from the belt. A spring resiliently pivots the support to the non-operative position spaced from the belt. In order to position the support in engagement with the belt, a bellows, in contact with the support, is inflated so as to overcome the spring force and pivot the support into the operative position in engagement with the belt.

U.S. Pat. No. 4,230,406 describes a bellows which engages a surface of the photoconductive belt opposed from a cleaning roller. When the bellows is inflated, the photoconductive belt is deflected into engagement with the cleaning roller to remove particles therefrom. When the bellows is deflated, the photoconductive belt is spaced from the cleaning roller.

In accordance with one aspect of the present invention, there is provided an electrophotographic printing machine of the type having a moving flexible photoconductive belt with a plurality of processing stations located adjacent one surface thereof. Means are provided for supporting and guiding the belt in an endless path of movement. Means, mounted on the support means, maintain a region of the belt opposed from at least one of the processing stations substantially planar. The maintaining means dampens flutter of the photoconductive belt.

Figure 2:
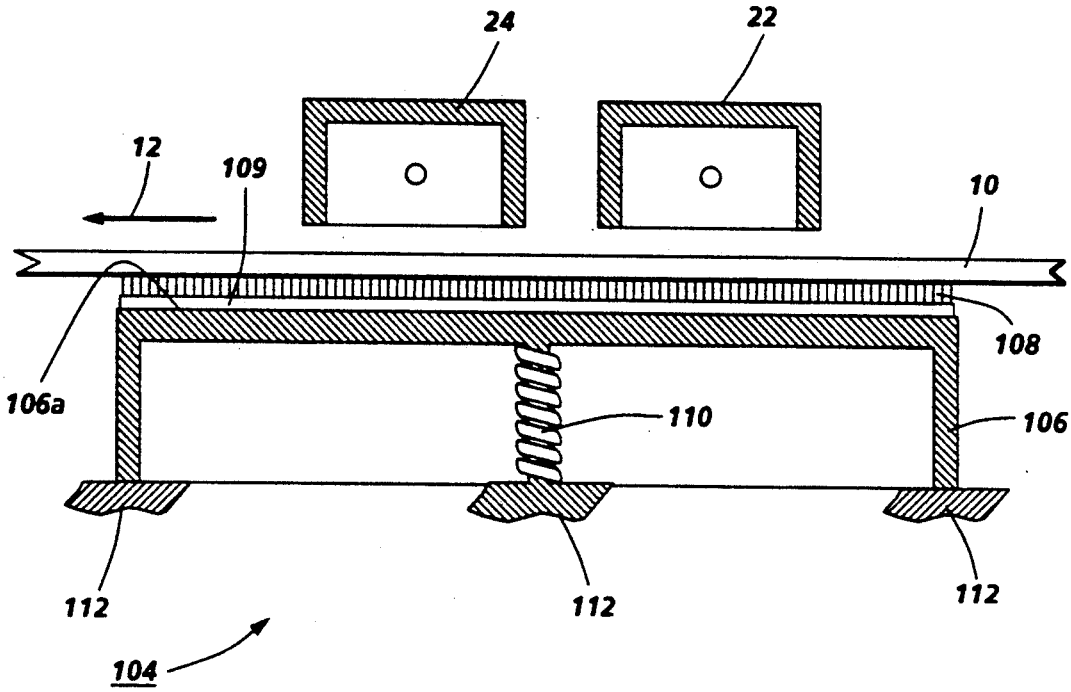

Other aspects of the present invention will become apparent as the following description precedes and upon reference to the drawings, in which:

FIG. 1 is a schematic elevational view depicting an illustrative electrophotographic printing machine incorporating the photoconductive belt support system of the present invention; and FIG. 2 is a schematic elevational view showing the details of the photoconductive belt support used in FIG. 1 printing machine.

While the present invention will hereinafter be described in connection with a preferred embodiment thereof, it will be understood that it is not intended to limit the invention to that embodiment. On the contrary it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the belt support of the present invention may be employed in a wide variety of printing machines and is not specifically limited in its application to the particular embodiment depicted herein.

Referring now to FIG. 1 of the drawings, the electrophotographic printing machine employs a photoconductive belt 10. Preferably, the photoconductive belt 10 is made from a photoconductive material coated on a ground layer, which, in turn is coated on an anti-curl backing layer. The photoconductive material is made from a transport layer coated on a generator layer. The transport layer transports positive charges from the generator layer. The interface layer is coated on the ground layer. The transport layer contains small molecules of di-m-tolydiphenylbiphenyldiamene dispersed in a polycarbonate. The generation layer is made from trigonal selenium. The ground layer is made from a titanium coated mylar. The ground layer is very thin and allows light to pass therethrough. One skilled in the art will appreciate that other suitable photoconductive material, ground layers, and anti-curl backing layers may also be employed. Belt 10 moves in the direction of arrow 12 to advance successive portions of the photoconductive surface sequentially through the various processing stations disposed about the path of movement thereof. Belt 10 is entrained about stripping roller 14, tensioning roller 16, idler rollers 18, and drive roller 20. Stripping roller 14 and idler rollers 18 are mounted rotatably so as to rotate with belt 10. Tensioning roller 16 is resiliently urged against belt 10 to maintain belt 10 under the desired tension. Drive roller 20 is rotated by a motor coupled thereto by suitable means, such as a belt drive. As roller 20 rotates, it advances belt 10 in the direction of arrow 12.

Initially, a portion of the photoconductive surface passes through charging station A. At charging station A, two corona generating devices, indicated generally by the reference numerals 22 and 24 charge photoconductive belt 10 to a relatively high, substantially uniform potential. Corona generating device 22 places all of the require charge on photoconductive belt 10. Corona generating device 24 acts as a leveling device, and fills in any areas missed by corona generating device 22. Belt support 104 is shown positioned opposed from charging station A. However, it may be positioned opposed from any or all of the processing stations positioned about the periphery of photoconductive belt 10. Support 104 maintains the region of photoconductive belt 10 opposed from corona generating devices 22 and 24 substantially flat and free of flutter. Support 104 dampens any photoconductive belt flutter. Support 104 is mounted between rolls 14, 16, 18, and 20 on the frame supporting photoconductive belt 10. Thus, the frame which supports the various rollers also supports support 104. The details of support 104 will be discussed hereinafter with respect to FIG. 2.

With continued reference to FIG. 1, next, the charged portion of photoconductive belt 10 is advanced through imaging station B. At imaging station B, a document handling unit, indicated generally by the reference numeral 26 is positioned over platen 28 of the printing machine. Document handling unit 26 sequentially feeds documents from a stack of documents placed by the operator in the document stacking and holding tray. The original documents to be copied are loaded face up in the document tray on top of the document handling unit. A document feeder, located below the tray, forwards the bottom document in the stack of rollers. The rollers advance the document onto platen 28. When the original document is properly positioned on platen 28, a belt transport is lowered onto the platen with the original document being interposed between the platen and the belt transport. After imaging, the original document is returned to the document tray from platen 28 by either of two paths. If a simplex copy is being made or if this is the first pass of a duplex copy, the original document is returned to the document tray by the simplex path. If this is an inversion pass of a duplex copy, then the original document is returned to the document tray through the duplex path. Imaging of a document is achieved by two Xenon flash lamps 30 mounted in the optical cavity illuminate the document on platen 28. Light rays reflected from the document are transmitted through lens 32. Lens 32 focuses light images of the original document onto the charged portion of the photoconductive surface of belt 10 to selectively dissipate the charge thereon. The region of photoconductive belt 10 being illuminated is maintain substantially flat. Of course, one skilled in the art will appreciate that support 104 may also be used in the exposure unit for supporting the belt. In this way, an electrostatic latent image is recorded on photoconductive belt 10 which corresponds to the informational areas contained within the original document. One skilled in the art will appreciate that instead of a light lens optical system, a raster input scanner (RIS) in combination with a raster output scanner (ROS) may be used. The RIS captures the entire image from the original document and converts it into a series of raster scan lines. The RIS contains document illumination lamps, optics, and mechanical scanning mechanism, and a photosensing element, such as a charged coupled device (CCD array). The ROS, responsive to the output from the RIS, performs the function of recording the electrostatic latent image on the photoconductive surface. The RIS lays out the latent image in a series of horizontal scan lines with each line having a certain number of pixels per inch. The ROS may include a laser, rotating polygon mirror blocks, and a modulator. Other suitable devices may be used in lieu of a laser beam, for example, light emitting diodes may be used to irradiate the charged portion of the photoconductive surface so as to record selected information thereon. Still another type of exposure system employs only a ROS. The ROS is connected to a computer and the document desired to be printed is transmitted from the computer to the ROS. In all of the foregoing systems, the charged photoconductive surface is selectively discharged to record an electrostatic latent image thereon. Thereafter, belt 10 advances the electrostatic latent image recorded on the photoconductive surface to development station C.

At development station C, a magnetic brush developer unit, indicated generally by the reference number 34, has three developer units indicated generally by the reference numerals 36, 38 and 40. A paddle wheel 42 picks up developer material and delivers it to the developer rolls. When the developer material reaches rolls 36 and 38, it is magnetically split between the rolls with half of the developer material being delivered to each roll. Photoconductive belt 10 is partially wrapped about rolls 36 and 38 to form extended development zones. Developer roll 40 is a clean up roll. Magnet roll 44 is a carrier granules removal device adapted to remove any carrier granules adhering to belt 10. Thus, rolls 36 and 38 advance developer material into contact with the electrostatic latent image. The latent image attracts toner particles from the carrier granules of the developer material to form a toner powder image on the photoconductive surface of belt 10. Belt 10 then advances the toner powder image to transfer station D. Here also, support 104 may be employed to maintain the region of photoconductive belt 10 opposed from developer unit C substantially planar.

At transfer station D, a copy sheet is moved into contact with the toner powder image. First, photoconductive belt 10 is exposed to a pretransfer light from a lamp (not shown) to reduce the attraction between the photoconductive belt 10 and the toner powder image. Next, a corona generating device 46 charges the copy sheet to the proper magnitude and plurality so that the copy sheet is tacked to the photoconductive belt and the toner powder image attracted from the photoconductive belt to the copy sheet. After transfer, corona generator 48 charges the copy sheet to the opposite plurality to detack the copy sheet from belt 10. Conveyor 50 advances the copy sheet to fusing station E. Here also, support 104 may be used to maintain the region of photoconductive belt 10 opposed from transfer unit D substantially planar. In addition, the support 104 also dampens any photoconductive belt flutter. Next, the copy sheet passes to fusing station E. Fusing station E includes a fuser assembly, indicated generally by the reference numeral 52. Fuser assembly 52 permanently affixes the transfer toner powder image to the copy sheet. Preferably, fuser assembly 52 includes a heated fuser roller 54 and a pressure roller 56 with the powder image on the copy sheet contacting fuser roller 54. The pressure roller is cammed against the fuser roller to provide the necessary pressure to fix the toner powder image to the copy sheet. The fuser roller is internally heated by a quartz lamp. Release agent, stored in a reservoir, is pumped to a metering roll. A trim blade trims off the excess release agent.

After fusing, the copy sheets are fed through a decurler 58. Decurler 58 bends the copy sheet in one direction to put a known curl in the copy sheet and then bends it in the opposite direction to remove that curl.

Forwarding roller 60 then advances the sheet to duplex turn roll 62. Duplex solenoid gate 64 guides the sheet to the finishing station and then to duplex tray 66. Duplex solenoid gate 64 diverts the sheet into duplex tray 66. Duplex tray 66 provides an intermediate or buffer storage for those sheets that have been printed one side on which an image will be subsequently printed on the second, opposed side thereof, i.e., the sheets being duplexed. The sheets are stacked in duplex tray 66 face down on top of one another in the order in which they are copied.

In order to complete duplex copying, the simplex shades in tray 66 are fed, in seriatim, by bottom feeder 68 from tray 66 back to transfer station D by a conveyor 70 and roller 72 for transfer of the toner powder image to the opposed sides of the copy sheets. It is much as successive bottom sheets are fed from duplex tray 66, the proper or clean side of the copy sheet is positioned in contact with belt 10 at transfer station D so that the toner powder image is transferred thereto. The duplex sheet is then fed through the same path as the simplex sheet to be advanced to finishing station E.

Copy sheets are fed to transfer station D from the secondary tray 74. The secondary tray 74 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 76. Sheet feeder 76 is a friction retard feeder utilizing a feed belt and take-away rolls to advance successive copy sheets to transport 70 which advances the sheets to roll 72 and then to transfer station D.

Copy sheets may also be fed to transfer station D from the auxiliary tray 78. The auxiliary tray 78 includes an elevator driven by a bidirectional AC motor. Its controller also has the ability to drive the tray up or down. When the tray is in the down position, stacks of copy sheets are loaded thereon or unloaded therefrom. In the up position, successive copy sheets may be fed therefrom by sheet feeder 80. Sheet feeder 80 is a friction retard feeder utilizing a feed belt and take-away rolls to advance successive copy sheets to conveyor 70 which advances the sheets to rolls 72 and then to transfer station D.

Secondary tray 74 and auxiliary tray 78 are secondary sources of copy sheets. A high capacity feeder, indicated generally by the reference numeral 82 is the primary source of copy sheets. High capacity feeder 82 includes a tray 84 supported on an elevator 86. The elevator is driven by a bidirectional motor to move the tray up or down. In the up position, the copy sheets are advanced from the tray to transfer station D. A vacuum feed belt 88 feeds successive uppermost sheets from the stack to a take-away drive roll 90 and idler rolls 92. The drive roll and idler rolls guide the sheet onto transport 93. Transport 93 and idler roll 95 advance the sheet to roll 72 which, in turn, move the sheet to transfer station D. Invariably, after the copy sheet is separated from the photoconductive surface of belt 10, some residual particles remain adhered thereto. After transfer, photoconductive belt 10 passes beneath corona generating device 94 which charges the residual toner particles to the proper plurality. Thereafter, a precharge erase lamp (not shown) located inside photoconductive belt 10 discharges the photoconductive belt in preparation for the next charging cycle. The residual particles are removed from the photoconductive surface at cleaning station G. Cleaning station G includes an electrically biased cleaning brush 96 and two de-toning rolls 98 and 100, i.e. waste and reclaim De-toning rolls. The reclaim roller is electrically biased negatively relative to the cleaner roll so as to remove toner particles therefrom. The waste roll is electrically biased positively relative to the reclaim roll so as to remove debris and wrong size toner particles. The toner particles on the reclaim roll are scraped off and deposited in a reclaim auger (not shown), where it is transported out of the rear of cleaning station G. Here also, support 104 may be utilized to maintain the region of photoconductive belt 10 opposed from cleaning station G substantially planar with photoconductive belt flutter being damped.

The various machine functions are regulated by a controller. The controller is preferably a programmable microprocessor that which controls all the machine functions here and before described. The controller provides a comparison count of the copy sheets, and the number of documents being recirculated, the number of copies selected by the operator, time delays, jam corrections, etc. The control of all of the exemplary systems heretofore described may be accomplished by conventional control switch inputs from the printing machine consoles selected by the operator. Conventional sheet path senses or switches may be used to keep track of the position of the documents and the copy sheets. In addition, the controller regulates the various positions of the gates depending upon the motive of operations selected.

It is believed that the foregoing description is sufficient for purposes of the present application to illustrate the general operation of an electrophotographic printing machine incorporating the features of the present invention therein.

Referring now to the specific subject matter of the invention, FIG. 2 shows support 104 in greater detail. As shown in FIG. 2, support 104 includes a platen 106. Platen 106 has a generally planar surface 106*a* opposed from the surface of photoconductive belt 10 in the region of corona generating devices 22 and 24. A pad 109 having a multiplicity of fibers 108 extending outwardly therefrom is adhesively secured to planar surface 106*a*. Alternatively, the fibers may be directly coated on platen surface 106*a*. Platen 106 is mounted on frame 112 adapted to support photoconductive belt 10. A coil spring 110 having one end thereof in engagement with platen 106 and the other end thereof secured to frame 112 resiliently urges platen 106 toward photoconductive belt 10. Thus, fibers 108, which are interposed between photoconductive belt 10 and platen 106, are pressed into engagement with photoconductive belt 10 in the region opposed from current generating devices 22 and 24. In this way, a carpet like layer of material is pressed into engagement with one surface of the photoconductive belt in the region opposed from a processing station to dampen belt flutter. Hence, as photoconductive belt 10 moves in the direction of arrow 12, platen 106 is resiliently urged by spring 110 toward belt 10. Fibers 1-8 extending outwardly from surface 106*a* of platen 106 contact the moving photoconductive belt and dampen any movement, i.e. flutter, in a direction substantially normal to the direction of belt movement, as indicated by arrow 12. Of course, one skilled in the art will appreciate that support 104, as previously indicated, may be positioned opposed from any of the other processing stations, e.g. exposure, development, transfer, or cleaning.

By way of example, fibers 108 may be made from a polyamide material, such as Nylon. The fiber yarn type is a non-textured, continuous multi-filament. The linear density of the fibers is about 57.8 grams/1000 meters. The fiber, i.e. filament, count is about 34. The pile filament shape is a round cross section. The backing or pad 109 is made from polyester with a yarn count of 20 and a cotton count of 2. The filament yarn count is 20. The backing yarn is twisted with the direction being 14 Z singles. The turns/24 millimeters is about 10 S double ply. The pad fabric ranges in thickness from about 0.5 millimeters to about 1.0 millimeter. The total pad and fiber thickness is about 4.2 millimeters. The pad, i.e. backing, weave is plain. The pile or fiber weave is 8 pick, W tuft, plush weave. The fabric count with a 20/2 cubic centimeters of polyester is about 60 picks/24.5 millimeters. The pile ends are 47 1/520/34 denier Nylon. The pile tufts/25.4 millimeters are about 15. The pile tufts/645 millimeters$^2$ are about 353. The pile fibers/645 millimeters$^2$ are about 26,122. The backing ends/25.4 millimeters, 20/2 cubic centimeters polyester are about 47. The total warp ends/25.4 millimeters are about 94. The pad back is preferably coated with a synthetic acrylic solution to seal the fiber ends. The pad back coating weight in 1448 millimeters is about 216 grams/linear meter.

In recapitulation, the support of the present invention dampens photoconductive belt flutter in a region opposed from a printing machine processing station. Damping is achieved by a multiplicity of fibers being resiliently urged into contact with the side of the photoconductive belt opposed from the processing station.

It is, therefore, evident that there has been provided, in accordance with the present invention, a photoconductive belt support that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications, and variations as forward in the spirit and broad scope of the appended claims.

We claim:

1. An electrophotographic printing machine of the type having a moving flexible photoconductive belt with a plurality of processing stations located adjacent one surface of the belt, including:

means for supporting and guiding said belt in an endless path of movement;

a platen opposed from one of the processing stations;

means, interposed between said platen and the photoconductive belt surface opposed therefrom, for dampening flutter of the photoconductive belt; and means for resiliently urging said platen toward the photoconductive belt to press said dampening means into contact with the photoconductive belt surface opposed therefrom to dampen flutter of the photoconductive belt.

2. A printing machine according to claim 1, wherein said supporting means includes:

a frame member; and a plurality of support rollers spaced from one another for supporting said belt.

3. A printing machine according to claim 2, wherein said urging means includes a spring engaging said platen to resiliently urge said platen toward the photoconductive belt to press said dampening means into contact with the photoconductive surface opposed therefrom.

4. A printing machine according to claim 3, wherein said dampening means includes a multiplicity of fibers extending outwardly from said platen, said fibers contacting the photoconductive belt surface opposed therefrom.

5. A printing machine according to claim 4, wherein the processing station opposed from said dampening means includes means for charging the photoconductive belt.

6. A printing machine according to claim 4, wherein the processing station opposed from said dampening means includes means for cleaning particles from the photoconductive belt.

7. A printing machine according to claim 4, wherein the processing station opposed from said dampening means includes means for transferring particles from the photoconductive belt to a copy sheet.

8. A printing machine according to claim 4, wherein the processing station opposed from said dampening means includes means for illuminating the photoconductive belt.

9. A printing machine according to claim 4, wherein the processing station opposed from said dampening means includes means for depositing particles on the photoconductive belt.

* * * * *